US007096552B1

(12) United States Patent
Ho

(10) Patent No.: US 7,096,552 B1
(45) Date of Patent: Aug. 29, 2006

(54) RING PRESSER FOR STAPLING PAPERS

(75) Inventor: Chih-Kwo Ho, Hsin-Chuang (TW)

(73) Assignee: Ta Ta Office Products Inc., Taipei (TW)

( * ) Notice: Subject to any disclaimer, the term of this patent is extended or adjusted under 35 U.S.C. 154(b) by 0 days.

(21) Appl. No.: 11/120,972

(22) Filed: May 4, 2005

(51) Int. Cl.
*B42C 19/00* (2006.01)
*B42B 4/00* (2006.01)

(52) U.S. Cl. ..... 29/243.58; 29/243.517; 412/33

(58) Field of Classification Search ..... 227/76, 227/66, 67, 68, 107, 108; 402/1, 7, 26, 29, 402/13; 412/38–43.22, 33; 29/243, 243.517, 29/243.57, 243.58
See application file for complete search history.

(56) References Cited

U.S. PATENT DOCUMENTS 3,699,596 A * 10/1972 Lyon ..... 412/13
3,811,146 A * 5/1974 Abildgaard et al. ..... 412/13
3,945,073 A * 3/1976 Adams ..... 412/39
3,967,336 A * 7/1976 Cutter ..... 412/13
4,141,100 A * 2/1979 Domroe et al. ..... 412/37
4,354,783 A * 10/1982 Szanto ..... 412/13
4,640,451 A * 2/1987 Steiner et al. ..... 227/76
4,645,399 A * 2/1987 Scharer ..... 412/16
5,211,522 A * 5/1993 Ho ..... 412/16
5,419,668 A * 5/1995 Ballist ..... 412/40
5,575,188 A * 11/1996 Hu ..... 83/167
5,971,689 A * 10/1999 Scharer et al. ..... 412/33
6,074,151 A * 6/2000 Pas ..... 412/38
6,079,924 A * 6/2000 Chiang ..... 412/33
6,295,908 B1 * 10/2001 Holzhauser et al. ..... 83/76.9
2004/0240968 A1 * 12/2004 Knight ..... 412/38

* cited by examiner

*Primary Examiner*—Scott A. Smith
*Assistant Examiner*—Brian Nash
(74) *Attorney, Agent, or Firm*—Troxell Law Office, PLLC

(57) ABSTRACT

A ring presser for stapling papers comprises a chassis and a clipping device. The clipping device is composed of lateral plates, a handle, an axial rod having gears on its both ends, a fixed pressing rod, a movable base, a clipping plate, and a cover. A fixed pressing rod is locked on the lateral plates. A guiding plate of the movable base is inserted into one set of slideways formed on the inner surfaces of the lateral plates. Gear racks are formed on the backside of the movable base. A connection plate is transversely mounted over the guiding plate to connect with the clipping plate. A guiding plate of the clipping plate is inserted into the other set of slideways. A bolt is applied to couple the movable base with the clipping plate. The gear racks are meshed with the axial rod that connects with the handle.

3 Claims, 7 Drawing Sheets

RING PRESSER FOR STAPLING PAPERS

FIELD OF THE INVENTION

The present invention relates to a ring presser for stapling papers, and more particularly to a clipping device has an improved axial rod for improving the stability of operation.

BACKGROUND OF THE INVENTION

The general puncher for use in papers also includes a stapling device so that the same device can punch and staple the papers. In order to prevent the paper of the papers from falling, a ring must be first inserted into the punched hole on the papers, and then the stapling device is applied to press the ring for holding the papers. However, in the conventional stapling device, the entire axial rod is covered with a gear. During the operation, the gear and the gear racks are meshed with one another, and shifted together. Because the gear and the gear racks must be fitted closely and exactly with one another, when the axial rod is slightly damaged or deformed, the operation is affected by the poor closeness between them.

SUMMARY OF THE INVENTION

It is a main object of the present invention to provide a ring presser for stapling papers, wherein gears are mounted merely on both ends of the axial rod to increase the operation stability and simplify the processing and manufacture.

Other objects and features of the present invention will become apparent from the following detailed description when taken in conjunction with the drawings in which:

DETAILED DESCRIPTION OF THE PREFERRED EMBODIMENT

The above-mentioned features and advantages of this invention, and the manner of attaining them, will become more apparent and the invention will be better understood by reference to the following description of embodiments of the invention taken in conjunction with the drawings.

Figure 1:
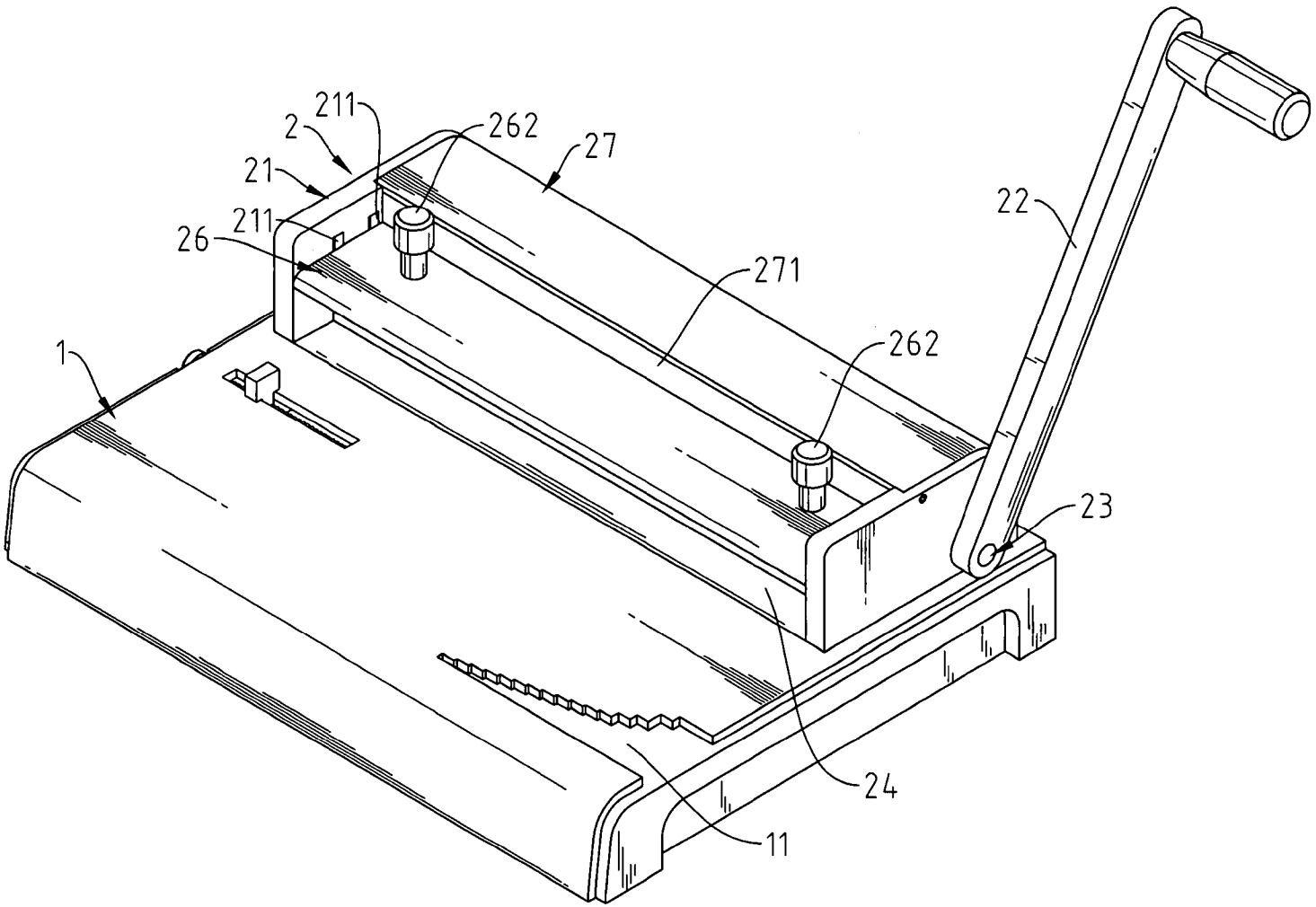
FIG. 1 is an elevational view showing the appearance of the present invention.
Figure 2:
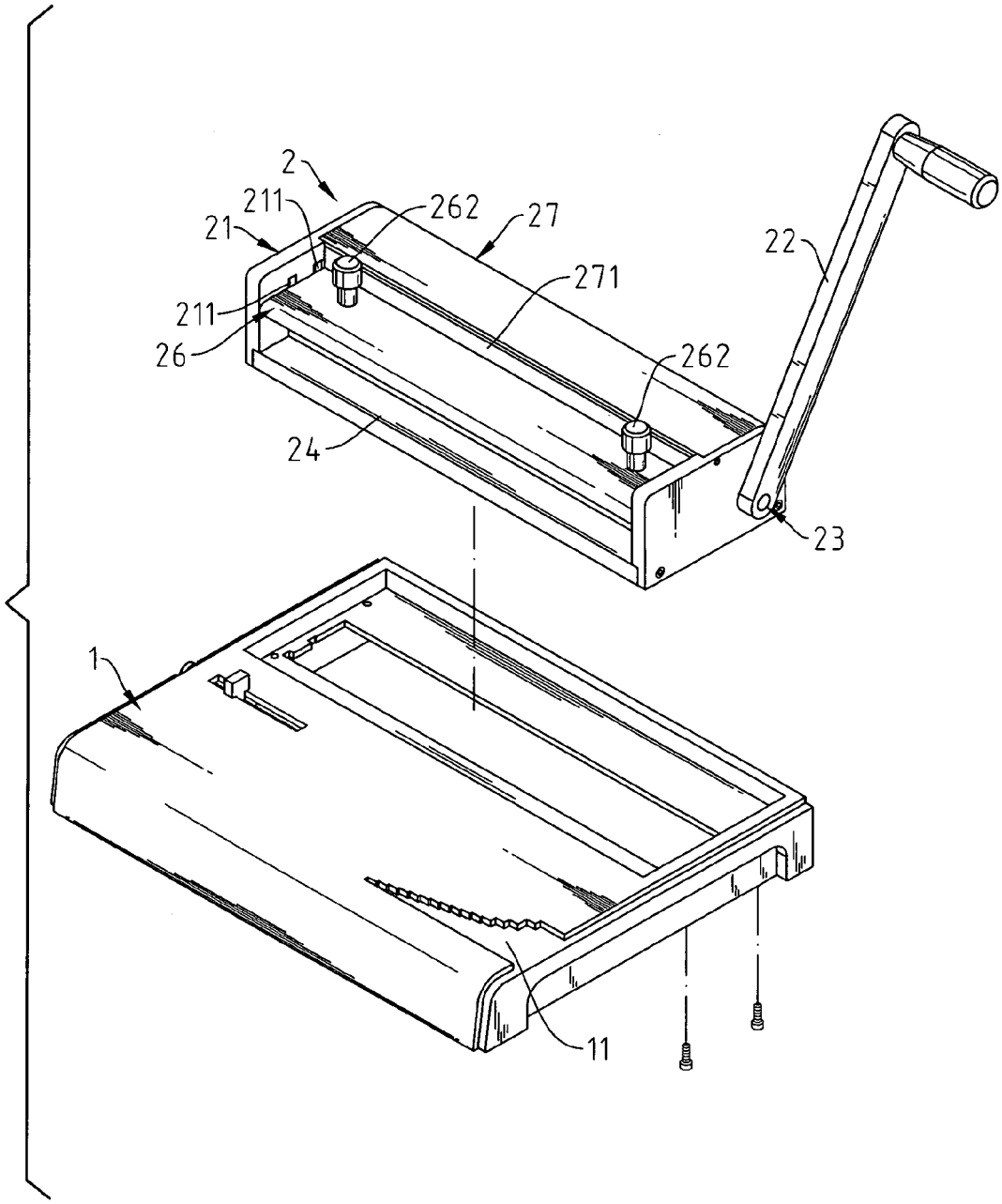
FIG. 2 is an elevational exploded view showing the chassis and the clipping device of the present invention.

Referring to FIG. 1 and FIG. 2, the ring presser for stapling papers of the present invention comprises a chassis 1 and a clipping device 2, wherein the clipping device 2 is composed of two lateral plates 21, a handle 22, an axial rod 23, a fixed pressing rod 24, a movable base 25, a clipping plate 26, and a cover 27.

Figure 3:
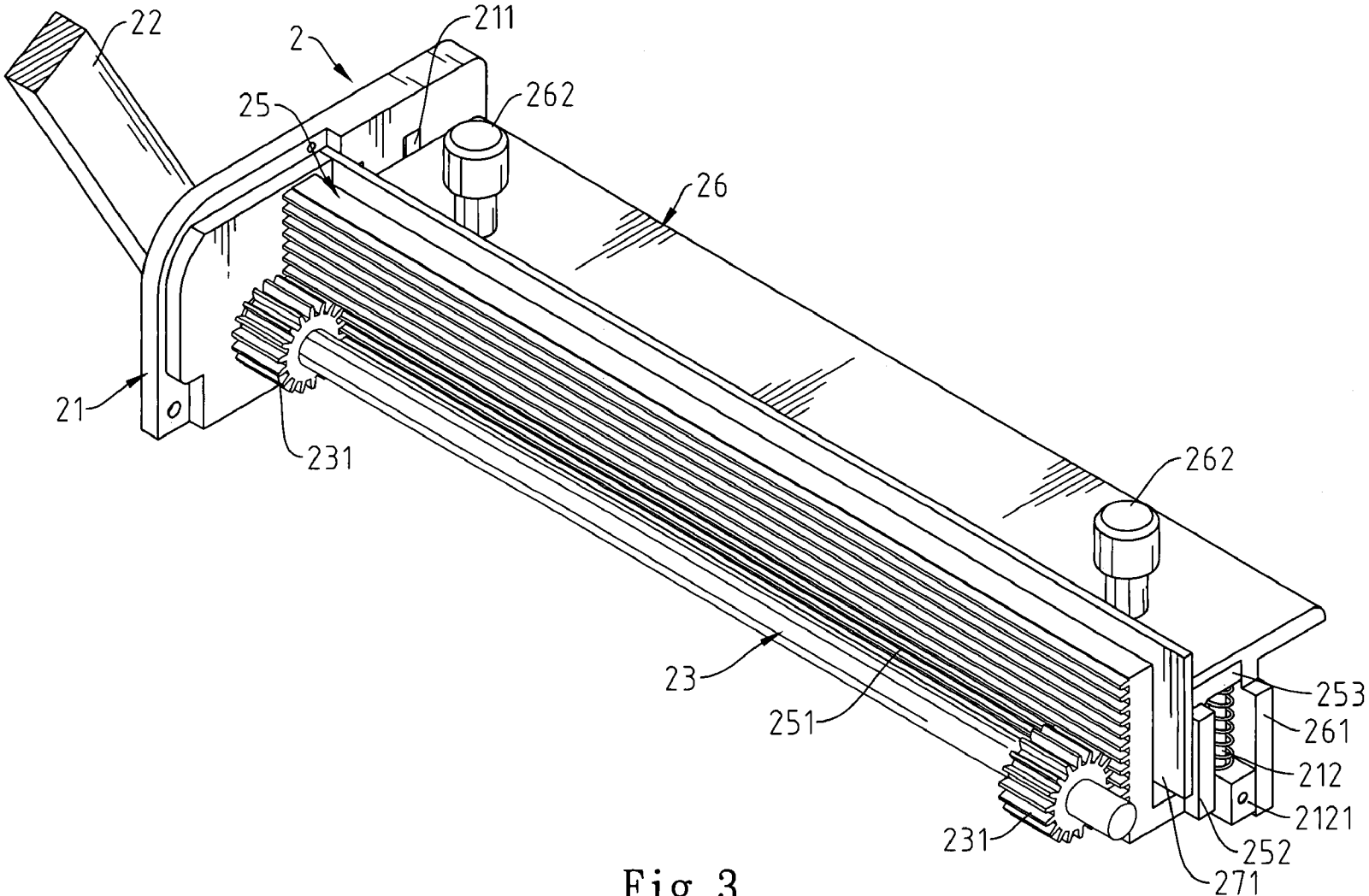
FIG. 3 shows an elevational appearance of the clipping device of the present invention as viewed in another direction.
Figure 4:
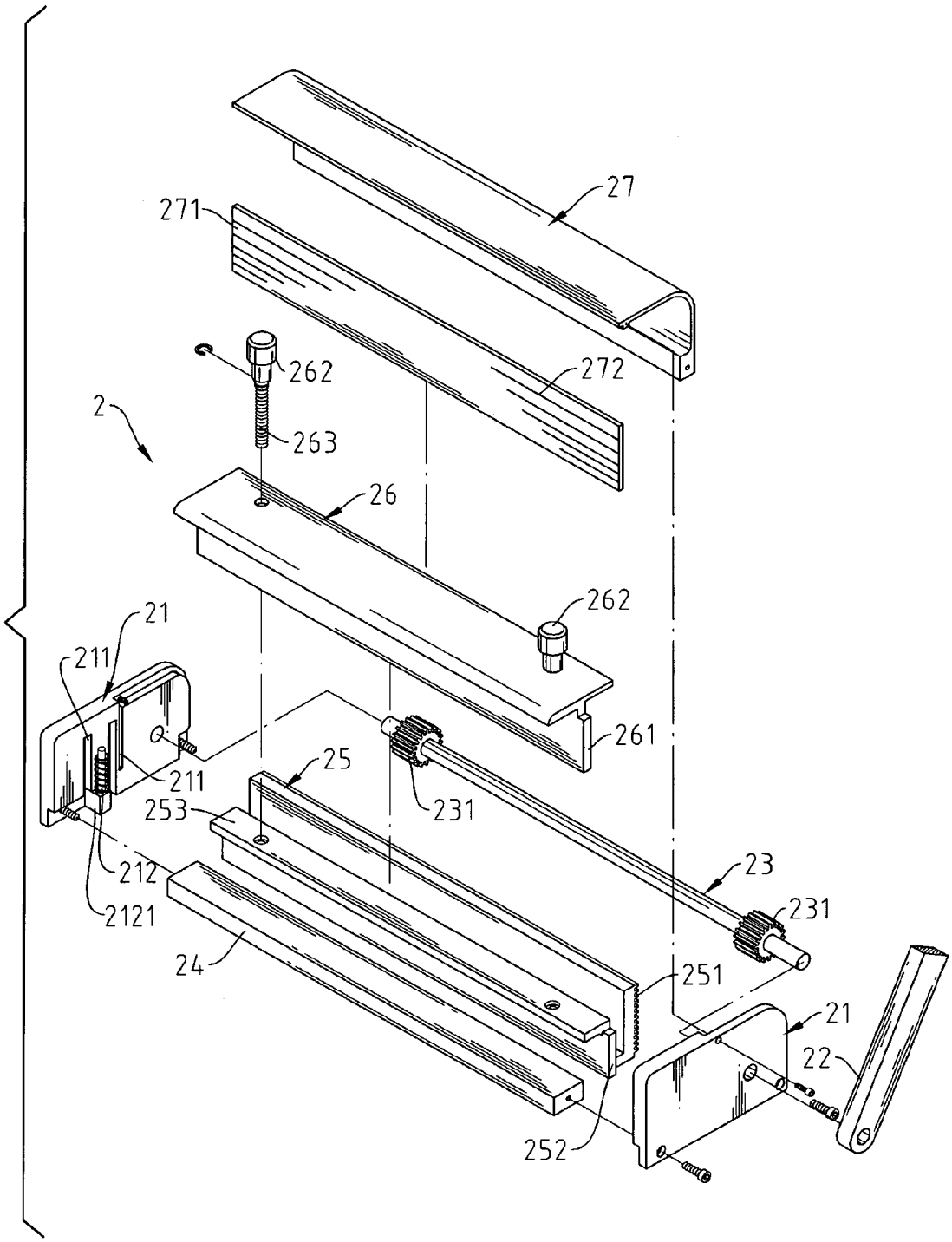
FIG. 4 is an elevational exploded view showing the clipping device of the present invention.

FIG. 3 and FIG. 4 are exploded views showing the clipping device 2. Two sets of slideways 211 are mounted respectively on inner surfaces of the lateral plates 21 of the clipping device 2. Two elastic guiding means 212 are mounted between these two sets of slideways 211. A fixed pressing rod 24 is immovably locked on the front lower portion of the inner surface of each lateral plate 21. The movable base 25 is inserted into one set of slideways 211 by use of its guiding plate 252, wherein gear racks 251 are backwardly extended from the guiding plate 252 and formed on the backside of the movable base 25. Besides, a connection plate 253 is transversely mounted over the guiding plate 252 to connect with the clipping plate 26. The clipping plate 26 is in the form of a T shape, and a guiding plate 261 mounted below the clipping plate 26 is inserted into the other set of slideways 211 formed on the lateral plates 21. A bolt 262 having threads 263 can be applied to couple the movable base 25 with the clipping plate 26. The gear racks 251 of the movable base 25 is meshed with the axial rod 23 that axially connects with the handle 22 and that includes two gears 231 on its both ends respectively. The small mesh area between the two gears 231 and the gear racks 251 improves the conventional large mesh area, decreases the deformation between the gears and the gear racks, and improves the operation stability.

Besides, in order to maintain the pleasing appearance of the ring presser and prevent the operation of the clipping device 2 from accident, the outside of the components is covered with the cover 27 having a fixed plate 271 mounted therein. The fixed plate 271 further includes a scale 272 formed thereon. The scale 272 may be applied together with a graduated rule 11 formed on the chassis 1 for adjustment according to the thickness of the papers. Consequently, the present invention is much more accurate in stapling the papers.

When the connection plate 253 of the movable base 25 is pressed down, the elastic guiding means 212 mounted on the inner surfaces of both lateral plates 21 are applied to supply the elastic supporting force. Beside, the downward shifting of the connection plate 253 is limited to a limit block 2121 that mounts under each of the elastic guiding means 212.

Figure 5:
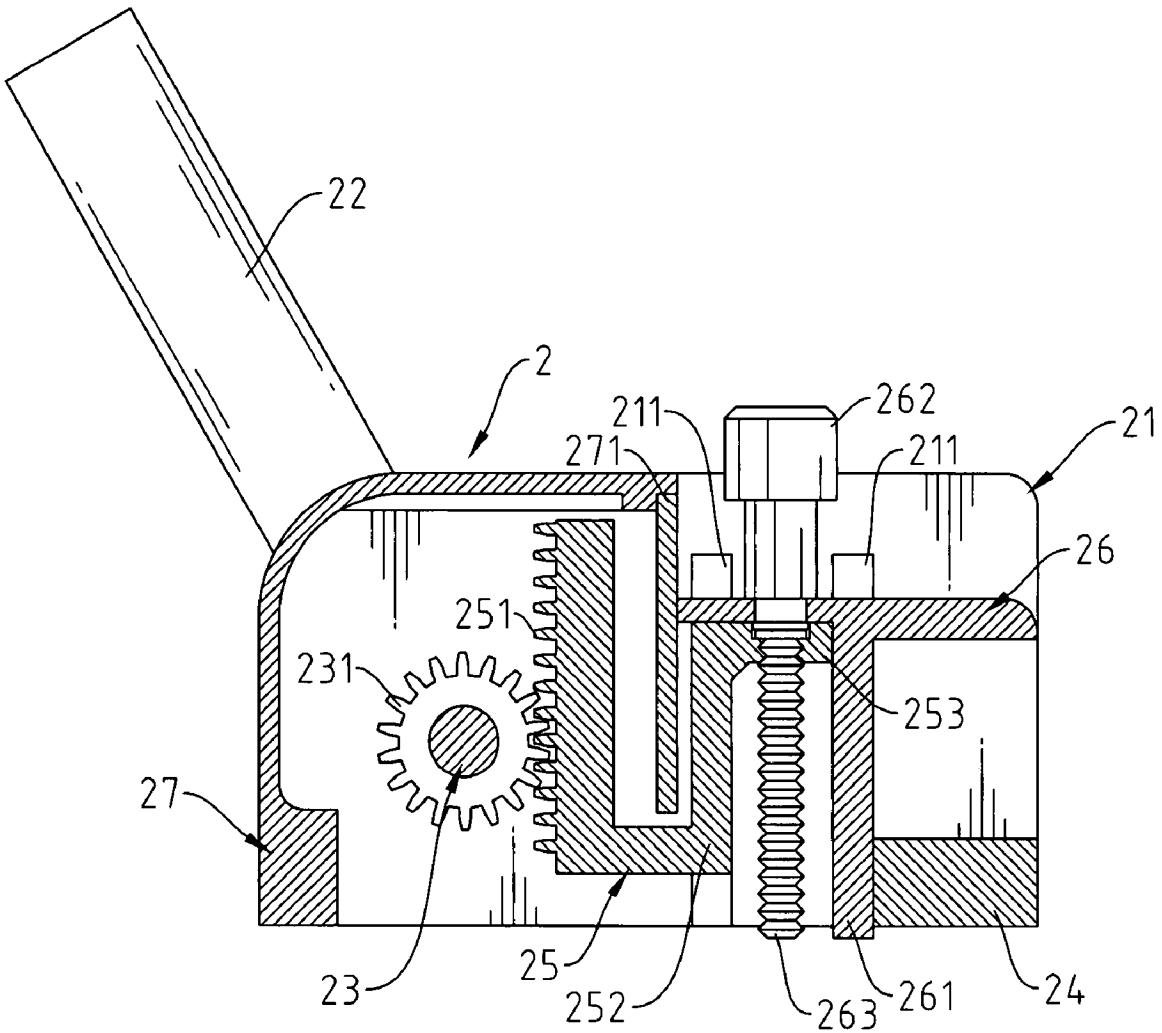
FIG. 5 is a cross-sectional view showing the clipping device of the present invention.
Figure 6:
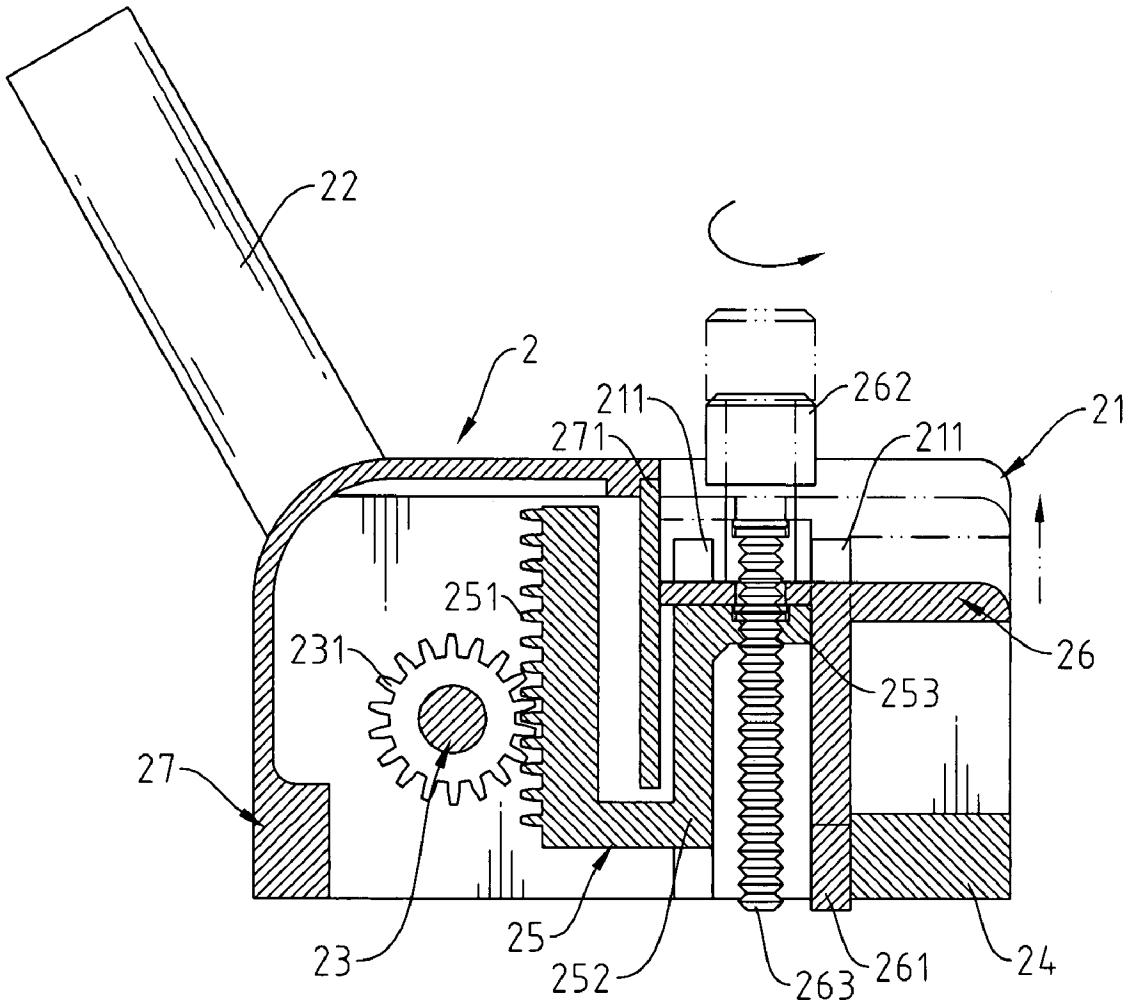
FIG. 6 is a schematic view showing the first usage status of the clipping device of the present invention.
Figure 7:
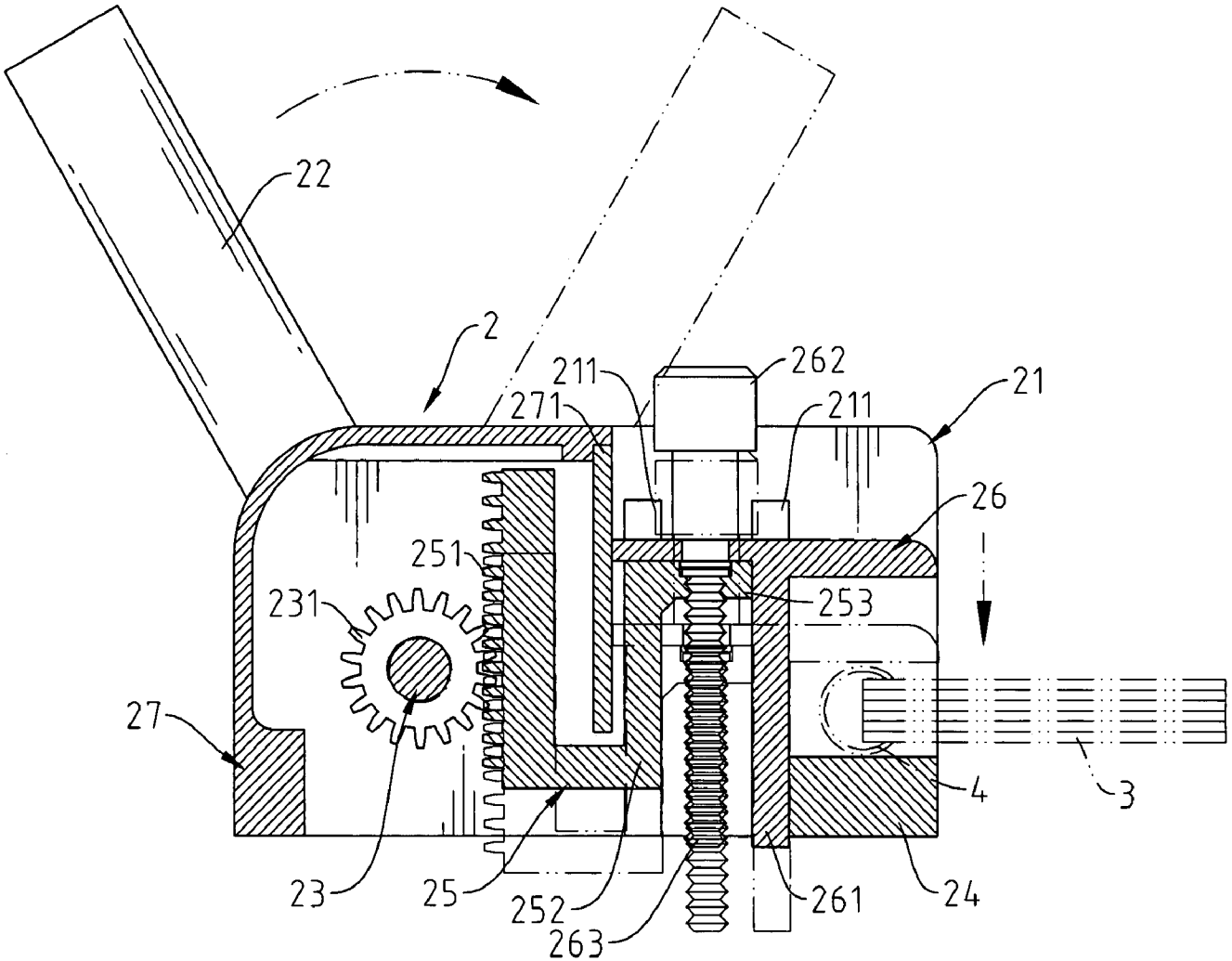
FIG. 7 is a schematic view showing the second usage status of the clipping device of the present invention.

Referring to FIG. 5 through FIG. 7, when the clipping device 2 of the ring presser of the present invention is in use, the bolt 262 can be applied to adjust the distance between the guiding plate 261 and the fixed pressing rod 24 to correspond to the thickness of the papers 3. When the handle 22 is operated for coupling the papers 3 with the ring 4, the gears 231 of the axial rod 23 can shift the gear racks 251 downward. Therefore, the movable base 25 is shifted downward by use of its guiding plate 252 that shifts along one set of slideways 211. In that case, since the clipping plate 26 and the movable base 25 are locked with one another, the clipping plate 26 is also shifted downward by use of its guiding plate 261 that shifts along the other set of slideways 211. Accordingly, when the clipping plate 26 is shift down, it will touch and press the top of the ring 4.

On the basis of the description mentioned above, the improvement on the axial rod significantly increases the operation stability of the ring presser for stapling the papers. Besides, the processing and manufacture can be easily performed without high technology.

While the preferred embodiment of the invention has been set forth for the purpose of disclosure, modifications of the disclosed embodiment of the invention as well as other embodiments thereof may occur to those skilled in the art.

Accordingly, the appended claims are intended to cover all embodiments, which do not depart from the spirit and scope of the invention.

What the invention claimed is:

1. A ring presser for stapling papers comprising:

a) a chassis; and b) a clipping device connected to the chassis and having:

i) two lateral plates being spaced apart, each of the two lateral plates having a first slideway and a second slideway located on an inner surface thereof;

ii) an axle rod rotatably connected to the two lateral plates and having two gears;

iii) a handle connected to the axle rod;

iv) a fixed pressing rod being fixedly connected at opposing ends thereof to a front lower portion of the inner surface of each of the two lateral plates;

v) a movable base having a first guiding plate, two gear racks, and a connection plate, the two gear racks extending backwardly from behind the first guiding plate, and the connection plate is located on a top of the first guiding plate, one of two opposing ends of the first guiding plate is slidably inserted into the first slideway of each of the two lateral plates, one of the two gears meshing with each of the two gear racks;

vi) a clipping plate connected by at least one bolt to the connection plate and having a second guiding plate, one of two opposing ends of the second guiding plate is slidably inserted into the second slideway of each of the two lateral plates; and vii) a cover connected to the two lateral plates, wherein, when the handle moves downwardly, the axle rod rotates the two gears moving the two gear racks of the moveable base downwardly, the moveable base moving the clipping plate downwardly, and, when the handle moves upwardly, the axle rod rotates the two gears moving the two gear racks of the moveable base upwardly, the moveable base moving the clipping plate upwardly.

2. The ring presser according to claim 1, further comprising two elastic guiding devices and two limiting blocks, one of the two elastic guiding devices is located on the inner surface of each of the two lateral plates providing an elastic supporting force for the connection plate, and one of the two limiting blocks is located below each of the two elastic guiding devices adjacent to the fixed pressing rod limiting a downward movement of the connection plate.

3. The ring presser according to claim 1, wherein the at least one bolt selectively adjusting a position of the second guiding plate relative to the fixed pressing rod.

* * * * *